United States Patent [19]

Nakajima et al.

[11] 4,106,471

[45] Aug. 15, 1978

[54] INTERNAL COMBUSTION ENGINE SYSTEM WITH AN AIR-FUEL MIXTURE SHUT OFF MEANS

[75] Inventors: Yasuo Nakajima, Yokosuka; Yoshimasa Hayashi, Yokohama, both of Japan

[73] Assignee: Nissan Motor Company, Ltd., Japan

[21] Appl. No.: 698,880

[22] Filed: Jun. 23, 1976

[30] Foreign Application Priority Data

Jun. 24, 1975 [JP] Japan ..... 50-78354

[51] Int. Cl.[2] ..... F02D 13/06

[52] U.S. Cl. ..... 123/198 F; 60/323; 123/193 H

[58] Field of Search ..... 123/198 F, 191 S, 193 H, 123/119 A; 60/323

[56] References Cited

U.S. PATENT DOCUMENTS

| | | | |
|---|---|---|---|
| 2,576,819 | 11/1951 | Angle | 123/193 A X |
| 2,667,151 | 1/1954 | Marx | 60/323 X |
| 3,578,116 | 5/1971 | Nakajima et al. | 123/198 F X |
| 3,768,787 | 10/1973 | Marsee | 123/119 A X |
| 3,901,202 | 8/1975 | Hollis, Jr. et al. | 123/119 A |
| 4,018,048 | 4/1977 | Matsuoka et al. | 60/323 |

FOREIGN PATENT DOCUMENTS

| | | | |
|---|---|---|---|
| 1,217,420 | 2/1959 | France | 123/191 S |

*Primary Examiner*—Charles J. Myhre
*Assistant Examiner*—Ira S. Lazarus

[57] ABSTRACT

An air-fuel mixture shut off means connected to selected branch tubes of an intake manifold of the engine and includes dampers swingably mounted in the selected branch tubes and a controller operable to close the dampers when the engine is decelerated.

12 Claims, 3 Drawing Figures

INTERNAL COMBUSTION ENGINE SYSTEM WITH AN AIR-FUEL MIXTURE SHUT OFF MEANS

The present invention relates in general to an internal combustion engine system which is arranged to produce a minimum amount of harmful combustible compounds, and more particularly to a multi-cylinder type internal combustion engine system having an engine proper with a plurality of combustion chambers several of which are arranged to be temporarily prevented from fuel supply thereinto. More specifically, the present invention is concerned with air-fuel mixture shut off means which comprises dampers swingably and respectively disposed in selected branch tubes of an intake manifold, and a controller to swingably move the dampers to close the respective branch tubes when the engine is decelerated and/or run at low load.

In connection with the multi-cylinder type internal combustion engine having in each combustion chamber, for example, two symmetrically spaced spark plugs, it is recognized that the combustion process of the airfuel mixture in each of the combustion chambers is completed in a relatively short period of time for thereby preventing a large production of harmful compounds while maintaining the normal rotational operation of the engine crankshaft. In reality, with this construction, even when a high degree of feed of the exhaust gases into the intake, for example in the range from 12 to 25% by volume of the intake air, is carried out, the normal rotation of the engine crankshaft as well as the high degree of reduction of nitrogen oxides (NOx) are continued or obtained without sacrificing the fuel economy of the engine.

However, in this kind of engine, there is a tendency in the combustion chamber that the amounts of the other harmful compounds such as hydrocarbons (HC) and carbon monoxide (CO) are inevitably increased due to the employment of the high degree of exhaust gas feed. Thus, in this engine system, it is necessary to employ a so-called aftercombustion device, such as a thermal reactor and/or a catalytic converter, for converting the combustible harmful compounds (HC) and (CO) into the harmless compounds.

Apart from this, when the internal combustion engine decelerates, the chamber pressure at the compression stroke of the engine is considerably lowered due to the occurrence of great vacuum in the intake manifold and the shortage of the air-fuel mixture intake furthermore, in this state of the engine, there remains a large amount of residual exhaust gases in the combustion chamber with a result that the unburned combustible compounds (HC) and (CO) are caused to increase in the exhaust gases.

This unwanted phenomenon will become more noticeable in the above-mentioned multi-cylinder type internal combustion engine system because of the employment of the high degree of exhaust gas feed into the intake.

Therefore, the present invention is proposed to eliminate the drawbacks of the conventional multi-cylinder type internal combustion engine as mentioned above.

It is an object of the present invention to provide a multi-cylinder type internal combustion engine system which produces exhaust gases containing reduced amounts of harmful compounds such as hydrocarbons (HC), carbon monoxide (CO) and nitrogen oxides (NOx) even when the engine is subjected to deceleration during cruising.

It is another object of the present invention to provide a multi-cylinder type internal combustion engine system having air-fuel mixture shut off means which is arranged to stop the air-fuel mixture supply into selected combustion chambers from air-fuel mixture supply means when the engine is decelerated.

It is still another object of the present invention to provide a multi-cylinder type internal combustion engine system including the above-mentioned air-fuel mixture shut off means, an intake manifold, two spark plugs in each of the combustion chambers, siamesed exhaust port outlets leading from the combustion chambers, a thermal reactor connected to the siamesed exhaust port outlet, and an exhaust gas feed means for feeding a portion of exhaust gases emitted from engine into an upstream portion of the intake manifold.

Other objects and advantages of the multi-cylinder type internal combustion engine system of the present invention will become more clear from the following description when taken in conjunction with the accompanying drawings, in which.

Figure 1:
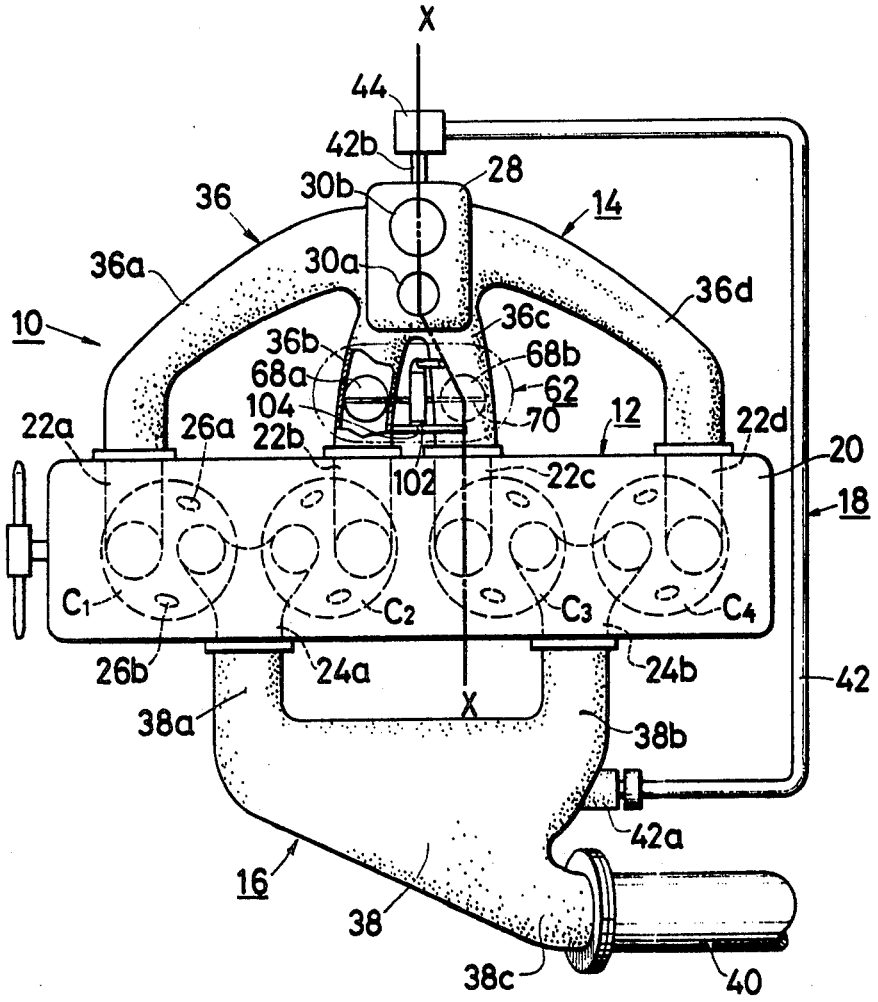
FIG. 1 is a plan view schematically illustrating a multi-cylinder type internal combustion engine system according to the present invention.

Referring now to FIG. 1 of the drawings, there is illustrated a multi-cylinder type internal combustion engine system 10 which generally comprises an engine proper section 12, an intake section 14, an exhaust section 16 and an exhaust gas feed section 18.

The engine proper section 12 is shown to have four combustion chambers $C_1$ to $C_4$ each consisting of an upper portion of a cylinder bore formed in a cylinder block (not shown) and a recess formed in a cylinder head 20. The cylinder head 20 is formed at one side thereof with four intake ports **22*a* to 22*d* which are respectively communicable with the four combustion chambers $C_1$ to $C_4$ through respective intake valve (not shown). Furthermore, the cylinder head 20 is formed at the other side portion thereof with two siamesed exhaust port outlets 24*a* and 24*b* which the port outlet 24*a* is in communication with the combustion chambers $C_1$ and $C_2$ through respective exhaust valves (not shown), while the port outlet 24*b* is in communication with the chambers $C_3$ and $C_4$ through respective exhaust valves (not shown). As shown, the intake ports 22*a* to 22*d* and the siamesed exhaust port outlets 24*a* and 24*b* are positioned to extend in the opposite directions from the chambers $C_1$ to $C_4$ to make the cylinder head 20 of a cross-flow type. Projected into each of the combustion chambers $C_1$ to $C_4$ are two spark plugs 26*a* and 26*b***, though only the numerals on the chamber $C_1$ are shown, which are located generally symmetrically with respect to the center axis of the each combustion chamber.

Figure 2:
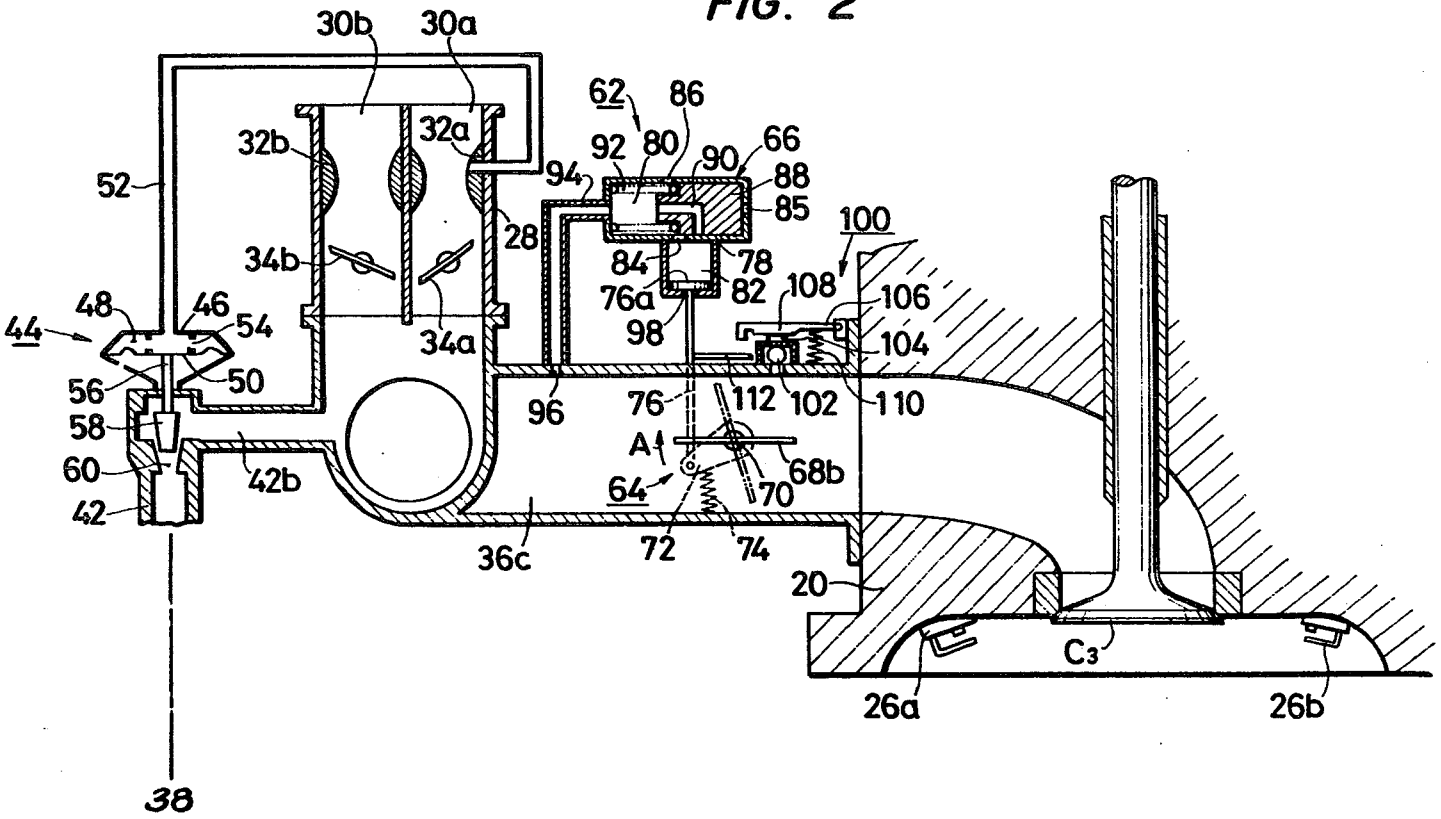
FIG. 2 is a sectional view taken along the line X—X of FIG. 1.

The intake section 14 generally comprises an air-fuel mixture supply means such as a carburetor 28 having primary and secondary barrels **30*a* and 30*b* in which respective venturi portions 32*a* and 32*b* and respective throttle valves 34*a* and 34*b* are mounted as well shown in FIG. 2. Connected downstream of the carburetor 28 is an intake manifold 36 which is provided with four branched off tubes 36*a* to 36*d* respectively connected at their leading ends to the intake ports 22***a* to 22*d* of the cylinder head 20 by suitable connecting means. Now, it is to be noted that the air-fuel mixture supply means may be a fuel injector in an air horn instead of the carburetor.

The exhaust section 16 comprises a thermal reactor 38 having two inlet tubes 38*a* and 38*b*, and an outlet tube 38*c* connected to an exhaust tube 40. These inlet tubes 38*a* and 38*b* are respectively connected to the siamesed exhaust port outlets 24*a* and 24*b* by means of a suitable connecting technic.

The exhaust gas feed section 18 into the intake comprises a conduit tube 42 having one end portion 42*a* opening into the thermal reactor 38 and the other end portion 42*b* opening into an air-fuel mixture passage downstream of the throttle valves of the intake manifold 36 as well shown in FIG. 2. Adjacent the other end portion 42*b* of the conduit tube 42 is arranged a gas flow controller 44 which functions to control the flow rate of the exhaust gases passing through the conduit tube 42 into the air-fuel mixture passage in response to the magnitude of venturi vacuum created in the carburetor 28. The detailed construction of the controller 44 is well illustrated in FIG. 2, in which a vacuum motor 46 defining therein an expansible chamber 48 partitioned by a diaphragm 50 is mounted on the conduit tube 42 adjacent the end portion 42*b*. As shown, the expansible chamber 48 is in constant communication with the interior of the primary barrel 30*a* through a tube 52 having an end projected into the venturi portion 32*a*. Within the chamber 48 is disposed a spring 54 which urges the diaphragm 50 in a direction to expand the chamber 48. Extending from the diaphragm 50 toward the interior of the conduit tube 42 is a valve stem 56 which has at its leading end a tapered valve head 58 sealingly contactable with a tapered orifice 60 defined in the conduit tube 42 as shown.

According to the present invention, there is further provided an air-fuel mixture shut off means 62 in the intake section 14 of the engine system 10. In this embodiment, the mixture shut off means 62 is assembled in selected branch tubes 36*b* and 36*c* of the intake manifold 36 as shown in FIG. 1. Under this arrangement of the mixture shut off means 62, it is preferable to arrange the ignition order of the combustion chambers such that the chambers $C_2$ and $C_3$ corresponding to the selected branched tubes 36*b* and 36*c* are not provided with subsequent ignition.

FIG. 2 shows the detailed construction of the air-fuel mixture shut off means 62 in which the means 62 generally comprises a damper mechanism 64, and a controller 66. The damper mechanism 64 includes two dampers 68*a* and 68*b* which are respectively disposed in the tubes 36*b* and 36*c* of the intake manifold 36 to pivot in unison on a common shaft 70 passing through both the tubes 36*b* and 36*c* as well shown in FIG. 1. Each damper 68*a* or 68*b* has a surface area almost sufficient to close the passage of the corresponding tube 36*b* or 36*c*. As seen from FIG. 2, an arm member 72 is connected at its one end portion to a longitudinally moddle portion of the shaft 70 for the swinging movement with the dampers 68*a* and 68*b*. A spring 74 is used for urging the arm member 72 and accordingly the dampers 68*a* and 68*b* in a direction to open the dampers 68*a* and 68*b*, as illustrated by a solid line in this drawing. Pivotally engaged with the other end of the arm member 72 is one end of a rod 76 which has the other end connected with the controller 66 which will be hereinbelow described.

The controller 66 comprises a generally T-shaped casing 78 having therein first and second chambers 80 and 82 which are fluidly communicable with each other through an opening 84 formed in a partition portion of the casing 78. The first chamber 80 is in constant communication with the interior of the selected tube 36*c* upstream of the damper 68*b* through a conduit tube 94 and an opening 96 formed in the tube 36*c* as shown. Furthermore, the first chamber 80 is fluidly communicable with the atmosphere through openings 85 and 86 formed also in the casing 78. Longitudinally and slidably disposed in the first chamber 80 is a piston 88 which is formed with an L-shaped passage 90 therein. Now, it is to be noted that the piston 88 can take first and second states thereof the first of which is a state wherein, as shown in this drawing, the two openings 84 and 86 of the casing 78 are not closed by the outer surface of the piston 88 thus to provide a fluid communication between the second chamber 82 and the atmosphere, the second of which is a state wherein the opening 86 is closed by the piston 88 and simultaneously the opening 84 fluidly agrees with the passage 90 of the piston 88 to provide a fluid communication between the first and second chambers 80 and 82. Within the first chamber 80 is disposed a compression spring 92 which urges the piston 88 in a direction to open the openings 84 and 86 (in a direction to allow the piston to take the first state). If desired, the piston 88 may be so formed with a shoulder portion to assuredly receive the one end of the compression spring 92. The urging force of the compression spring is so determined that when a vacuum above a predetermined level is introduced into the first chamber 80 from the interior of the tube 36*c* due to the closing of the throttle valves 34*a* and 34*b*, the piston 88 is moved to take the second state. Thus, upon taking the second state, the piston 88 can allow feeding the second chamber 82 with the vacuum from the first chamber 80.

Movably disposed in the second chamber 82 is the other end portion of the rod 76 which is connected with the damper mechanism 64 as mentioned hereinbefore. As shown, the other end portion of the rod 76 is provided with an enlarged head 76*a* having a side surface sealably and slidably engageable with the inner wall of the second chamber 82. An opening 98 through which the rod 76 is passed is formed to have a diameter considerably larger than that of the rod for acting as an air passage. By the urging force of the spring 74, the enlarged head 76*a* is normally positioned in its lowermost position as shown, wherein the dampers 68*a* and 68*b* are completely open.

According to the present invention, air intake means 100 is further provided and connected with the air-fuel mixture shut off means 62 and functions to allow the interior of tubes 36*b* and 36*c* at the portions downstream of the dampers 68*a* and 68*b* to fluidly communicate with the atmosphere when the dampers 68*a* and 68*b* are closed. The air intake means 100 comprises a conduit tube 102 which has both ends respectively opening into the interior of the tubes 36*b* and 36*c* at the positions downstream of the dampers 68*a* and 68*b*, as shown in FIG. 1. The conduit tube 102 is provided with an opening 104 at the longitudinally middle portion thereof for allowing a fluid communication between the interior of the tubes 36*b* and 36*c* and the atmosphere. Adjacent the opening 104 of the conduit tube 102, there is arranged a swingable valve member 106 which is pivotally supported at one end thereof on a suitable stationary member of the engine and is provided with a contact portion 108 sealingly contactable with the opening 104 of the conduit tube 102. The swingable valve member 106 is biased by a spring 110 to close the opening 104. A lever 112 having one end engageable with the leading end of the swingable valve member 106 is fixed to the beforementioned rod 76 as shown. It is to be noted that the lever 112 is arranged to lift the swingable valve member 106 when the rod 76 is moved upward a predetermined distance.

With the above described constructions of the engine system of the present invention, the operations of the air-fuel mixture shut off means 62 and the air intake means 100 are as follows:

Under the normal running of the vehicle, the magnitude of the intake vacuum appearing in the intake manifold 36 is relatively low since the throttle valves 34*a* and 34*b* are open or at least the valve 34*a* is open. In this condition, the piston 88 in the first chamber 80 is maintained in the first state mentioned hereinbefore since the vacuum supplied from the tube 36*c* into the first chamber 80 cannot overcome the urging force of the spring 92. Thus, the second chamber 82 is maintained to communicate with the atmosphere through the opening 86, the first chamber 80 and the opening 84, so that the enlarged head 76*a* of the rod 76 is caused to stay in the lowermost position, as shown. Accordingly, the dampers 68*a* and 68*b* are fully open, so that even distribution of the air-fuel mixture is made to each of the branch tubes 36*a* to 36*d* of the intake manifold 36. Of course, in this condition, the air intake means 100 does not provide the tubes 36*b* and 36*c* with the communication with the atmosphere.

When the vehicle is subjected to deceleration due to the closing of the throttle valves 34*a* and 34*b* to create an intake vacuum above the predetermined level, the piston 88 in the first chamber 80 is caused to move leftwardly by the suction effect of the intake vacuum and take the second state thereof. Thus, in this state, the intake vacuum is supplied into the second chamber 82 through the passage 90 formed in the piston 88 thereby moving up the enlarged head 76*a* of the rod 76. By this upward movement of the rod 76, the arm 72 rotates the dampers 68*a* and 68*b* in the direction, as shown by the arrow A, to close the passages of the tubes 36*b* and 36*c*. At the same time, the lever 112 lifts the leading end of the swingable valve member 106 to open the opening 104 formed in the conduit tube 102, so that the interiors of the tubes 36*b* and 36*c* downstream of the dampers 68*a* and 68*b* become in fluid communication with the atmosphere. Thus, in this condition, the air-fuel mixture originally supplied into the combustion chambers $C_2$ and $C_3$ is caused to be distributed to the other tubes 36*a* and 36*b* thereby increasing the amount of mixture actually received in the combustion chambers $C_1$ and $C_4$. Thus, the combustion in the chambers $C_1$ and $C_4$ is considerably improved due to the dissolution of the air-fuel mixture shortage in the combustion chambers $C_1$ and $C_4$ so that the hydrocarbon (HC) and the carbon monoxide (CO) contents in the exhaust gases from the engine are remarkably reduced.

Furthermore, in this instance, since the opening 104 in the conduit tube 102 is opened, the atmospheric air is fed through the opening 104 into the tubes 36*b* and 36*c* downstream of the dampers 68*a* and 68*b* to clear the vacuum condition existing at the moment in those portions. Thus, the closing effect of the dampers 68*a* and 68*b* against the air-fuel mixture is improved. The air introduced into the tubes 36*b* and 36*c* is passed through the combustion chambers $C_2$ and $C_3$ into the thermal reactor 38 for thus promoting the aftercombustion proceeding in the thermal reactor 38.

Figure 3:
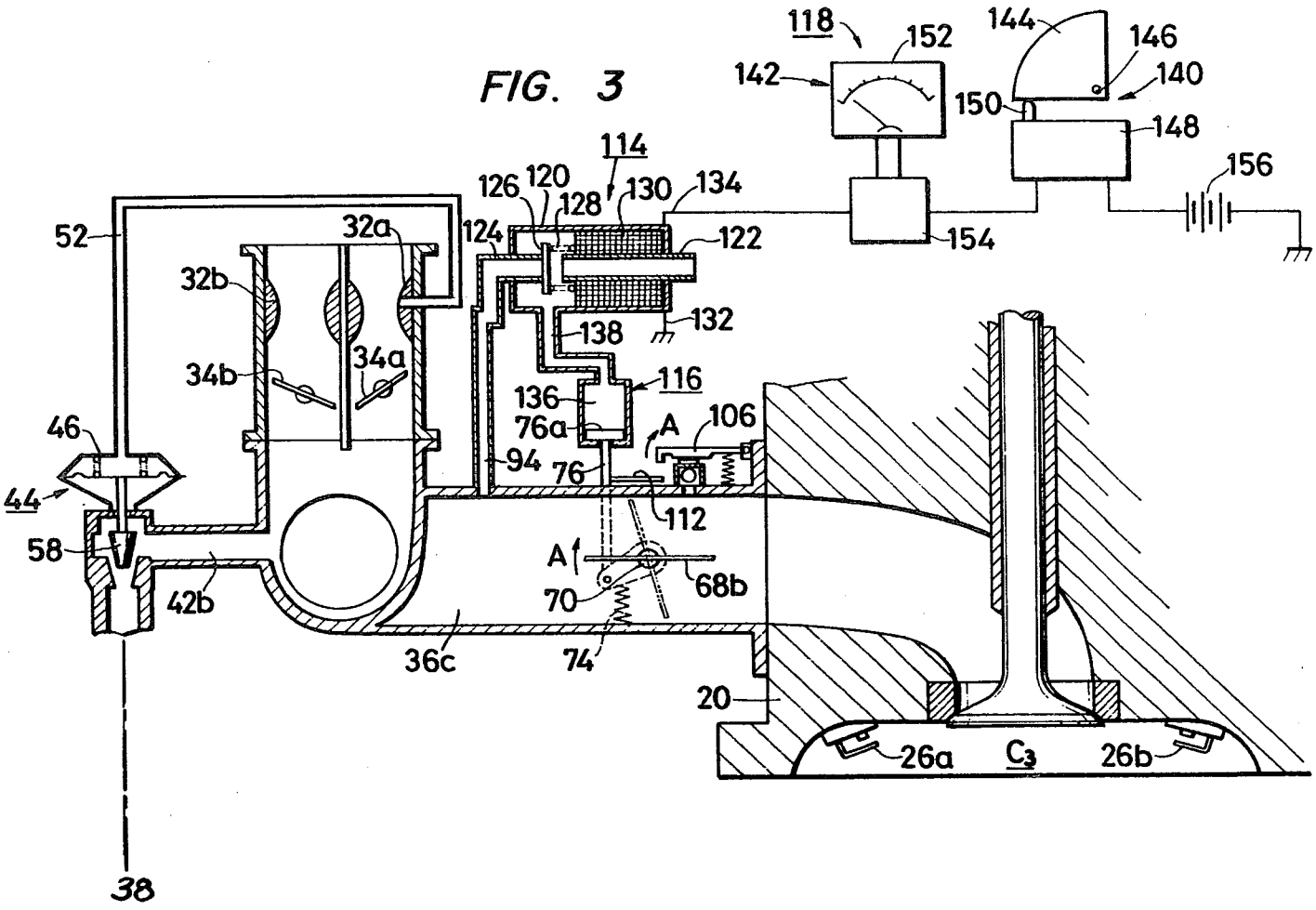
FIG. 3 is a similar view to FIG. 2 and shows another preferred embodiment of the engine system of the present invention.

FIG. 3 shows another preferred embodiment of the multi-cylinder type internal combustion engine system according to the present invention. In this embodiment, the opening-closing timing of the dampers 68*a* and 68*b* is controlled by an electric controller detecting both the rotating angle of the throttle valve 34*a* and the speed of the vehicle mounting the engine system.

In order to simplify the description of this embodiment, the explanation of the parts designated by the same reference numerals as in the first embodiment will be omitted from the following description.

The air-fuel mixture shut off means 62 according to this embodiment generally comprises a damper mechanism 64 having the same construction as in the first embodiment an electric controller 114, a chamber member 116 and deceleration sensing means 118.

The electric controller 114 comprises a casing 120 into which first and second tubes 122 and 124 are projected in such a manner that the respective inner open ends of the tubes 122 and 124 face each other provide fluid communication between the interior of the casing 120 and the atmosphere, and between the interior of the casing 120 and the interior of the tube 36*c* upstream of the damper 68*b*. A flat valve member 126 made of magnetic material is movably disposed in the casing 120 so as to selectively open or close the inner open ends of the tubes 122 and 124. A compression spring 128 is disposed between the open ends of the tubes 122 and 124 in the casing 120 to urge the flat valve member in a direction to close the opening end of the second tube 124. Mounted around the first tube 122 in the casing 120 is a solenoid coil 130 which has one terminal or lead wire 132 grounded and the other 134 connected to the sensing means 118 which will be hereinafter explained.

The chamber member 116 includes a casing (no numeral) defining therein a chamber 136 which communicates the interior of the casing 120 of the electric controller 114 through a tube 138. Slidably disposed in the chamber 136 of the chamber member 116 is the enlarged head 76*a* of the rod 76 which is connected with the damper mechanism 64 which has been mentioned in the first preferred embodiment.

The deceleration sensing means 118 comprises a throttle valve angle sensor 140 and a vehicle speed sensor 142.

The throttle valve angle sensor 140 includes a lever 144 firmly fixed to a shaft 146 which is constructed to simultaneously rotate with the throttle shaft (no numeral) of the throttle valve 34*a* by means of a suitable linkage. Of course, the lever 144 may be fixed directly to a portion or an extension of the throttle shaft of the throttle valve 34*a* without using the shaft 146. Connected with the lever 144 is a switch member 148 which has a movable contact 150 engageable with the lever 144 and functions to close the circuit therein when the movable contact 150 is downwardly pushed by the lever 144. In this embodiment, the throttle valve angle sensor 140 is arranged to close the circuit of the switch 148 when the throttle valve 34*a* is closed.

The vehicle speed sensor 142 includes a vehicle speedometer 152 and a switch member 154. The switch 154 is arranged to close the circuit therein when the vehicle speedometer 152 indicates a speed above a predetermined level, for example higher than 10 or 20 km/h. These switches 148 and 154 of the two sensors 140 and 142 are arranged in series and are electrically connected to a battery 156 and the other lead wire 134 of the solenoid coil 150 mentioned before, as shown.

With the above-mentioned construction of the second preferred embodiment of the engine system according to the invention, the operation of the air-fuel mixture shut off means is as follows.

Under the normal running of the vehicle, the throttle valve 34*a* is maintained open. Thus, the switch member 148 of the throttle valve angle sensor 140 is kept open to de-energize the solenoid coil 130 in spite of the closing condition of the switch member 154 of the vehicle speed sensor 142. Accordingly, in this instance, the flat valve member 126 takes a position, as shown, to close the second tube 124 by the assistance of the force of the compression spring 128. Under this condition, the chamber 136 of the chamber member 116 is kept in communication with the atmosphere through the first tube 122 and the tube 138, so that the rod 76 is caused to stay in the lowermost position, as shown, by the urging force of the spring 74. Thus, the dampers 68*a* and 68*b* are kept fully open to allow even air-fuel mixture distribution to the four tubes 36*a* to 36*d* of the intake manifold 36 from the carburetor 28. Of course, in this condition, the air intake means 100 does not provide the fluid communication between the interior of the tubes 36*b* and 36*c* and the atmosphere.

However, when the vehicle is subjected to deceleration due to closing of the throttle valves 34*a* and 34*b* and at the moment the vehicle continues to run at a speed higher than the predetermined level (for example, higher than 10 or 20 km/h), the two switch members 148 and 154 are both closed to energize the solenoid coil 130. Thus, in this instance, the flat valve member 126 is moved, against the couterforce of the compression spring 128 into another position to close the open end of the first tube 122. Accordingly, the vacuum created in the tube 36*c* is introduced into the chamber 136 of the chamber member 116 through the second tube 124 and the tube 138 to move up the enlarged head 76*a* of the rod 76. With this upward movement of the rod 76, the dampers 68*a* and 68*b* are rotated to close the respective tubes 36*b* and 36*c*, and at the same time, the fluid communication between the interiors of the tubes 36*b* and 36*c* downstream of the dampers 68*a* and 68*b* and the pressures are equalized in the same way as mentioned hereinbefore.

Although, in the previous description the detailed explanation of the exhaust gas feed to the intake or means 18 and the two spark plugs in each of the combustion chambers with respect to the operation and technical merits is not made, these will be well known to those skilled in the art.

From the above description, it will be clear that the engine system of the present invention can prevent substantial production of the harmful combustible compounds (such as HC and CO) contained in the exhaust gases from the combustion chambers even when the engine is decelerated. Thus, the thermal reactor can optimally operate without being fed with combustible compounds the amount of which is outside of the treatment limit of the thermal reactor.

In the previous description, the engine system of the invention is shown to combine with a carburetor. However, it is also possible to employ a so-called fuel injector in this engine system. In this case, it is necessary to arrange the fuel injector so that the fuel supply into the selected combustion chambers having no subsequent ignition is stopped under the deceleration of the engine of the vehicle. For detection of the engine or vehicle deceleration, the intake air flow, the engine speed and the throttle valve angle will be checked.

It is to be noted that the invention is not to be limited to the exact construction shown and described and that various changes and modifications may be made without departing from the spirit and scope of the invention, as defined in the appended claims.

What is claimed is:

1. An internal combustion engine system, comprising:

an engine having therein at least two combustion chambers each of which is provided with at least two spark plugs, each combustion chamber being communicable with corresponding intake and exhaust ports also formed in said engine;

intake means including an intake manifold having branch tubes respectively connected to said intake ports, and air-fuel mixture supply means located upstream of said intake manifold for supplying the air-fuel mixture to said combustion chambers through said branch tubes and said intake ports;

exhaust means communicating with said exhaust ports for collecting the high temperature spent gases from said exhaust ports and carrying them to an exhaust tube from which said spent gases are discharged to the atmosphere;

exhaust gas recirculating means for feeding a portion of the exhaust gases in said exhaust means into said intake means; and air-fuel mixture shut off means for blocking the air-fuel mixture supply into selected at least one of said combustion chambers when said engine is subjected to deceleration, said air-fuel mixture shut off means including:

at least one damper swingably disposed in the branch tube corresponding to said selected combustion chamber for selectively closing and opening the passage of said branch tube;

biasing means for biasing said damper in a direction to open said passage of the selected branch tube;

a vacuum motor means for moving said damper in a direction to close the passage of the selected branch tube against the counterforce of said biasing means when a predetermined degree of vacuum is applied thereto; and a three-way solenoid valve means having first, second and third tubes which are respectively communicated with the atmosphere, the interior of the selected branch tube upstream of said damper, and said vacuum motor means and functioning such that when it is electrically energized, a fluid communication between said second and third tubes is accomplished and simultaneously a communication between said first and third tubes is blocked, and when it is de-energized, the communication between said second and third tubes is blocked and simultaneously the communication between said first and third tubes is accomplished.

2. An internal combustion engine system as claimed in claim 1, further comprising an air intake means for providing a fluid communication between the interior of the selected branch tube downstream of said damper and the atmosphere when said damper is moved to close the passage of the selected branch tube.

3. An internal combustion engine system as claimed in claim 2, further comprising vehicle deceleration sensing means which allows said three-way solenoid valve means to be energized upon sensing the deceleration of the vehicle on which said engine is mounted.

4. An internal combustion engine system as claimed in claim 3, in which said vehicle deceleration sensing means comprises:

a throttle valve angle sensor having a first switch member which functions to close the circuit therein when a throttle valve located in said air-fuel mixture supply means is closed; and a vehicle speed sensor having a second switch member which functions to close the circuit therein when the vehicle runs at a speed higher than a predetermined level, said first and second switch members being arranged in a series and electrically connected to an electric power source and said three-way solenoid valve.

5. A multi-cylinder type internal combustion engine system, comprising:

an engine having therein a plurality of combustion chambers each of which is provided with at least two spark plugs, each combustion chamber being communicable with corresponding intake and exhaust ports also formed in said engine;

intake means including an intake manifold having branch tubes respectively connected to said intake ports of said engine, and air-fuel mixture supply means located upstream of said intake manifold for supplying the air-fuel mixture to said combustion chambers through said branch tubes and said intake ports;

exhaust means communicating with said exhaust ports of said engine for collecting the high temperature spent gases from said exhaust ports and carrying them to an exhaust tube from which said spent gases are vented to the atmosphere;

exhaust gas feed means for feeding a portion of the exhaust gases from said exhaust means into said intake means;

air-fuel mixture shut off means connected to selected members of said branch tubes of said intake manifold for blocking the air-fuel mixture supply into the combustion chambers corresponding to said selected branch tubes when said engine is decelerated, said air-fuel mixture shut off means including dampers respectively and swingably disposed in said selected branch tubes of said intake manifold for selectively closing and opening the passages of said selected branch tubes, said dampers being connected to a common shaft for rotating movement therewith and being biased in a direction to open the passage of the corresponding selected branch tubes;

damper control means for moving said dampers to close said corresponding passages of said selected branch tubes by the assistance of vacuum force created in one of said selected branch tubes when said deceleration of said engine takes place, said damper control means including a chamber member having therein a chamber;

passage means capable of providing a fluid communication between the chamber of said chamber member and the interior of said one of said selected branch tubes upstream of the corresponding damper;

a rod member having at one end an enlarged head portion slidably disposed in said chamber of said chamber member and at the other end a portion connection to said common shaft of said dampers through an arm member;

valve means fluidly disposed in said passage means and having first and second states thereof, the first of which is a state wherein the chamber of said chamber member is in communication with the atmosphere to allow the dampers to completely open the corresponding passages of said selected branches, the second of which is a state wherein the chamber of said chamber member is isolated from said atmosphere and simultaneously is in communication with the interior of said one of said selected branch tubes to allow the dampers to close the corresponding passages of said selected branch tubes, said first and second states of said valve means selectively taking place when said vehicle is under normal running and when subjected to deceleration, said valve means including a casing having therein a chamber into which first and second tubes are projected from opposite end portions of the casing so as to provide fluid communication between said chamber of said casing and the atmosphere, and between said chamber and the interior of said one of said selected branch tubes respectively, said chamber of said casing being in communication with said chamber of said chamber member;

a flat valve member made of magnetic material movably disposed in said chamber of said casing between the inner open ends of said first and second tubes so as to selectively close and open said inner open ends, said flat valve member being biased in a direction to close the inner open end of said second tube; and a solenoid coil mounted around said first tube in said casing so as to attract said flat valve member to close said inner open end of said first tube and at the same time to open said inner open end of said second tube when electrically energized under deceleration of said engine.

6. A multi-cylinder type internal combustion engine system as claimed in claim 5, further comprising vehicle deceleration sensing means which allows said solenoid coil to connect to an electric power source upon sensing the deceleration condition of said vehicle.

7. A multi-cylinder type internal combustion engine system as claimed in claim 6, in which said vehicle deceleration sensing means comprises:

a throttle valve angle sensor having a first switch member which functions to close the circuit therein when a throttle valve located in said air-fuel mixture supply means is closed; and a vehicle speed sensor having a second switch member which functions to close the circuit therein when said vehicle runs at a speed higher than a predetermined level, said first and second switch members being arranged in a series and connected to said electric power source and said solenoid coil of said valve means.

8. A multi-cylinder type internal combustion engine system as claimed in claim 7, in which each of said exhaust ports formed in said engine is combined with the neighboring exhaust port to form a siamesed exhaust port.

9. A multi-cylinder type internal combustion engine system as claimed in claim 7, in which said spark plugs in each of said combustion chambers are two spark plugs which are arranged symmetrically with respect to the center axis of the corresponding combustion chamber.

10. A multi-cylinder type internal combustion engine system as claimed in claim 8, in which said exhaust means comprises a thermal reactor having inlet tubes thereof fluidly and respectively connected to said siamesed exhaust ports of said engine, and an outlet tube thereof connected to said exhaust tube, said thermal reactor defining therein an after-combustion chamber for the combustion of harmful combustible compounds in said exhaust gases exhausted from said combustion chambers.

11. A multi-cylinder type internal combustion engine system as claimed in claim 7, in which said exhaust gas feed means includes:

a conduit tube having one end opening into an after-combustion chamber defined in said exhaust means and the other end opening into an air-fuel mixture passage defined in said intake means downstream of the throttle valve of said intake manifold; and an exhaust gas flow controller disposed in a portion of said conduit tube for controlling the flow rate of the exhaust gases passing through the conduit tube toward the air-fuel mixture passage from said thermal reactor in response to the magnitude of venturi vacuum created in said air-fuel mixture supply means.

12. A multi-cylinder type internal combustion engine system as claimed in claim 7, in which the combustion chambers connected with said selected branch tubes are so arranged that consequent ignition in said chambers is absent.

* * * * *